US006676576B1

(12) United States Patent
Wu

(10) Patent No.: US 6,676,576 B1
(45) Date of Patent: Jan. 13, 2004

(54) ADJUSTABLE PULL EXERCISER

(76) Inventor: Ying-Ching Wu, No. 32-2, Shin-Chi Village, An-Ding Shiang, Tainan Hsien (TW)

( * ) Notice: Subject to any disclaimer, the term of this patent is extended or adjusted under 35 U.S.C. 154(b) by 0 days.

(21) Appl. No.: 10/347,814

(22) Filed: Jan. 21, 2003

(51) Int. Cl.[7] ..... A63B 21/02
(52) U.S. Cl. ..... 482/126
(58) Field of Search ..... 482/126, 123, 482/95, 910, 125, 122, 121, 128, 129, 130, 81, 82

(56) References Cited

U.S. PATENT DOCUMENTS 4,225,131 A * 9/1980 Sidlinger et al.
5,431,617 A * 7/1995 Rattray, Jr.
5,885,196 A * 3/1999 Gvoich
6,500,105 B1 * 12/2002 Kuo

* cited by examiner

*Primary Examiner*—Jerome W. Donnelly
(74) *Attorney, Agent, or Firm*—Eric K. Satermo

(57) ABSTRACT

A pull exerciser includes two attachment members, two positioning devices respectively attached to the attachment members, and at least one resilient cord. Each positioning device includes two positioning plates each having at least one positioning hole that is communicated with outside via a reduced opening having a width smaller than a diameter of the positioning hole. The resilient cord is inserted into the positioning hole of each positioning plate through a respective reduced opening. An end piece is fixed to each end of the resilient cord and has a diameter greater than the diameter of the positioning hole of each positioning plate. The resilient cord can be replaced with other resilient cord having a different elastic coefficient. When several resilient cords are used, the user may attach additional resilient cords to or remove some of resilient cords from the pull exerciser when desired.

9 Claims, 6 Drawing Sheets

ADJUSTABLE PULL EXERCISER

BACKGROUND OF THE INVENTION

1. Field of the Invention

The present invention relates to an adjustable pull exerciser.

2. Description of the Related Art

FIG. 6 of the drawings illustrates a conventional pull exerciser including two attachment members 2 each having a hole 201, a resilient cord 1 having two ends respectively extending through the holes 201 of the attachment members 2, with an end piece 11 being attached to each end of the resilient cord 1, and two handles 2 respectively mounted to the attachment members 20. Each end piece 11 has a diameter greater than that of the hole 201 of the respective attachment member 2 to prevent the resilient cord 1 from disengaging from the respective attachment member 2. A user may grasp the handles 2 and pull the resilient cord 1 with both hands to exercise muscles of the arms and the chest. A disadvantage of this conventional pull exerciser is that the resilient cord 1 could not be replaced with other resilient cord having a different elastic coefficient. Another disadvantage of this conventional pull exerciser is that the user could not attach additional resilient cords as desired.

SUMMARY OF THE INVENTION

An object of the present invention is to provide an adjustable pull exerciser that allows a user to replace the resilient cord with other resilient cord having a different elastic coefficient.

Another object of the present invention is to provide an adjustable pull exerciser that has a plurality of resilient cords, allowing a user to attach additional resilient cords to or remove some of resilient cords from the pull exerciser when desired.

A pull exerciser in accordance with the present invention includes two attachment members each having a grip portion, two positioning devices respectively attached to the attachment members at a location opposite to the grip portion of an associated one of the attachment members, and at least one resilient cord. Each positioning device includes a first positioning plate and a positioning plate. The first positioning plate includes at least one first positioning hole that is communicated with outside via a first reduced opening having a width smaller than a diameter of the first positioning hole. The second positioning plate includes at least one second positioning hole that is communicated with outside via a second reduced opening having a width smaller than a diameter of the second positioning hole. The resilient cord has two ends each of which is insertable into the first positioning hole of the first positioning plate through the first reduced opening of the first positioning plate of an associated positioning device and into the second positioning hole of the second positioning plate through the second reduced opening of the second positioning plate of an associated positioning device. The resilient cord is so sized to be extendible through the positioning hole of the first positioning plate and the positioning hole of the second positioning plate. An end piece is fixed to each end of the resilient cord and has a diameter greater than the diameter of the first positioning hole of the first positioning plate and the second positioning hole of the second positioning plate.

In a preferred embodiment of the present invention, a pull exerciser includes:

two tubular handles;

two belts that are adjustable in length, each belt extending through an associated one of the tubular handles;

two positioning devices respectively attached to the belts at a location opposite to an associated one of the tubular handles, each positioning device including a first positioning plate and a second positioning plate, each of the first positioning plate and the second positioning plate having two slots defined in two ends thereof through which an associated one of the belts extends, each of the first positioning plate and the second positioning plate having a plurality of positioning holes, each positioning hole being communicated with outside via a reduced opening having a width smaller than a diameter of a respective positioning hole; and a plurality of resilient cords each having two ends respectively insertable into an associated one of the positioning holes of the first positioning plate through a respective reduced opening of the first positioning plate and into an associated one of the positioning holes of the second positioning plate through a respective reduced opening of the second positioning plate, each resilient cord being so sized to be extendible through the positioning holes of the first positioning plate and the second positioning plate, an end piece being fixed to each of the ends of each resilient cord and having a diameter greater than the diameter of each positioning hole of the first positioning plate and the second positioning plate, at least one of the resilient cords being selectively attached to the positioning devices.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
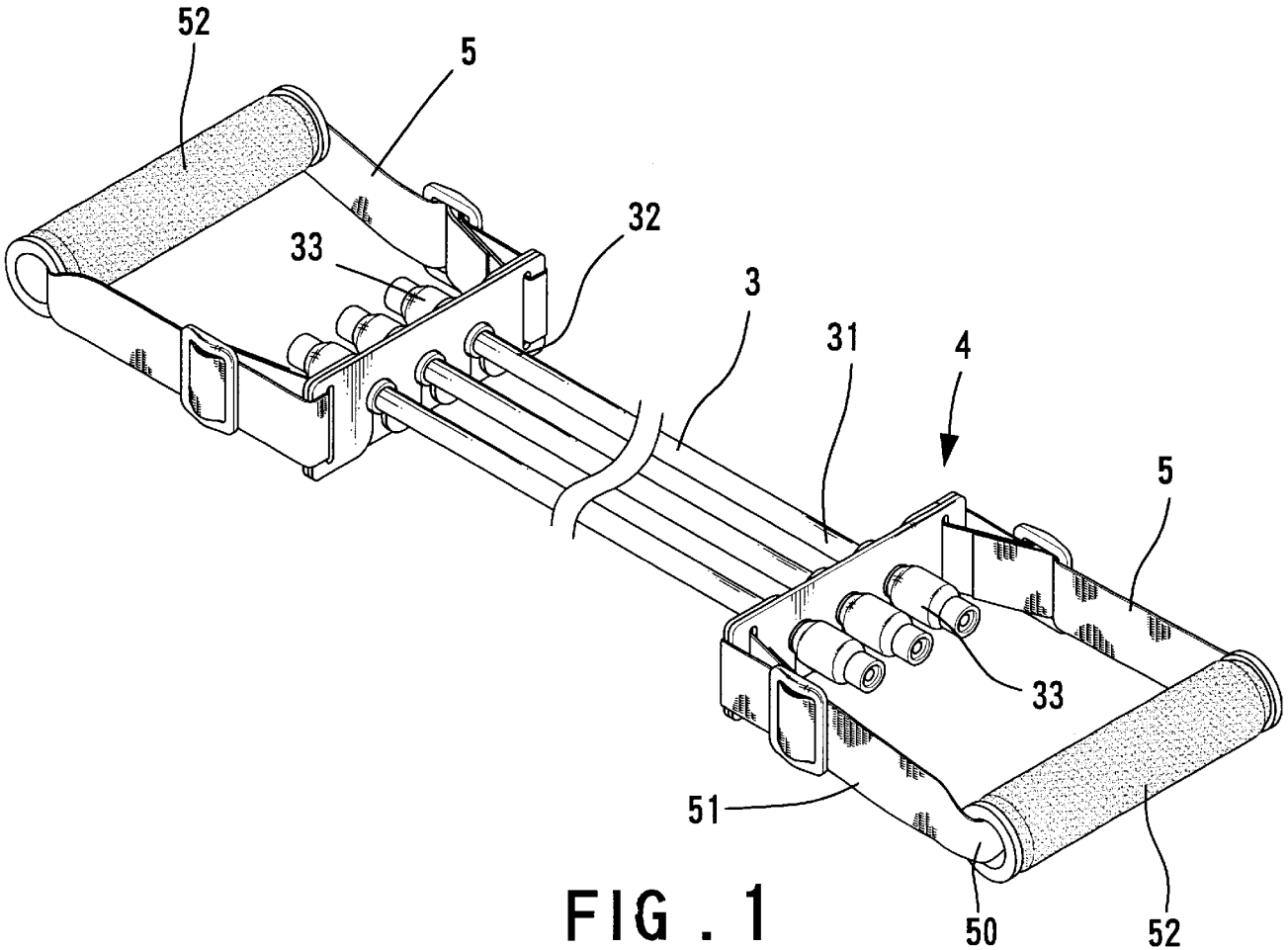
FIG. 1 is a perspective view of an adjustable pull exerciser in accordance with the present invention.

Referring to FIG. 1, an adjustable pull exerciser in accordance with the present invention generally comprises two attachment members 5, two positioning devices 4, and at least one resilient cord 3. In this embodiment, there are three resilient cords 3 each having an end piece 33 attached to each of two ends 31 and 32 thereof, and each attachment member 5 is in the form of a belt 51 whose length is adjustable. The belt 51 includes a grip portion 50 for user's grip. Alternatively, a tubular handle 52 is mounted around the grip portion 50 for easier grip.

Figure 2:
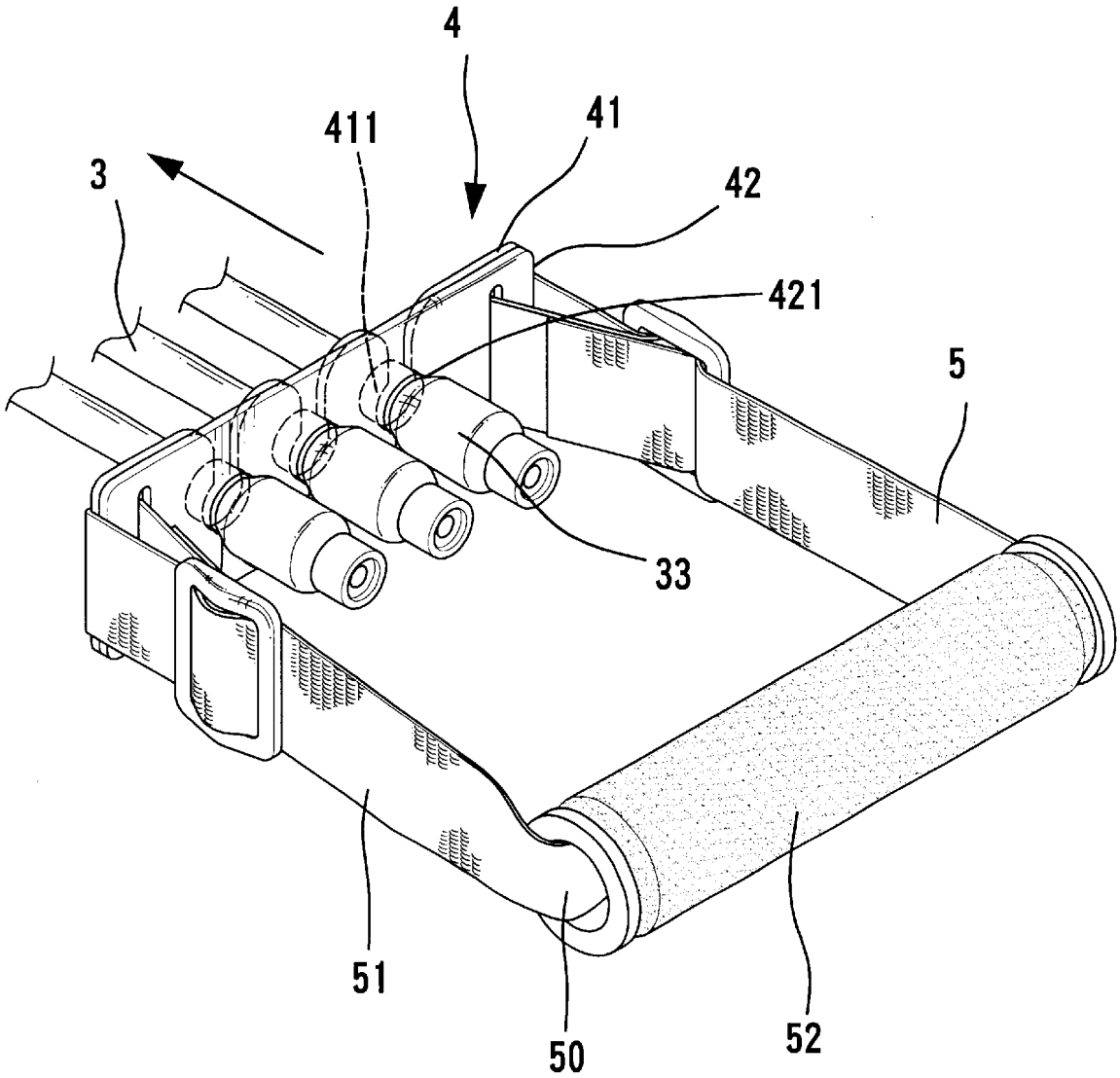
FIG. 2 is a perspective view, in an enlarged scale, of a portion of the adjustable pull exerciser in accordance with the present invention.
Figure 3:
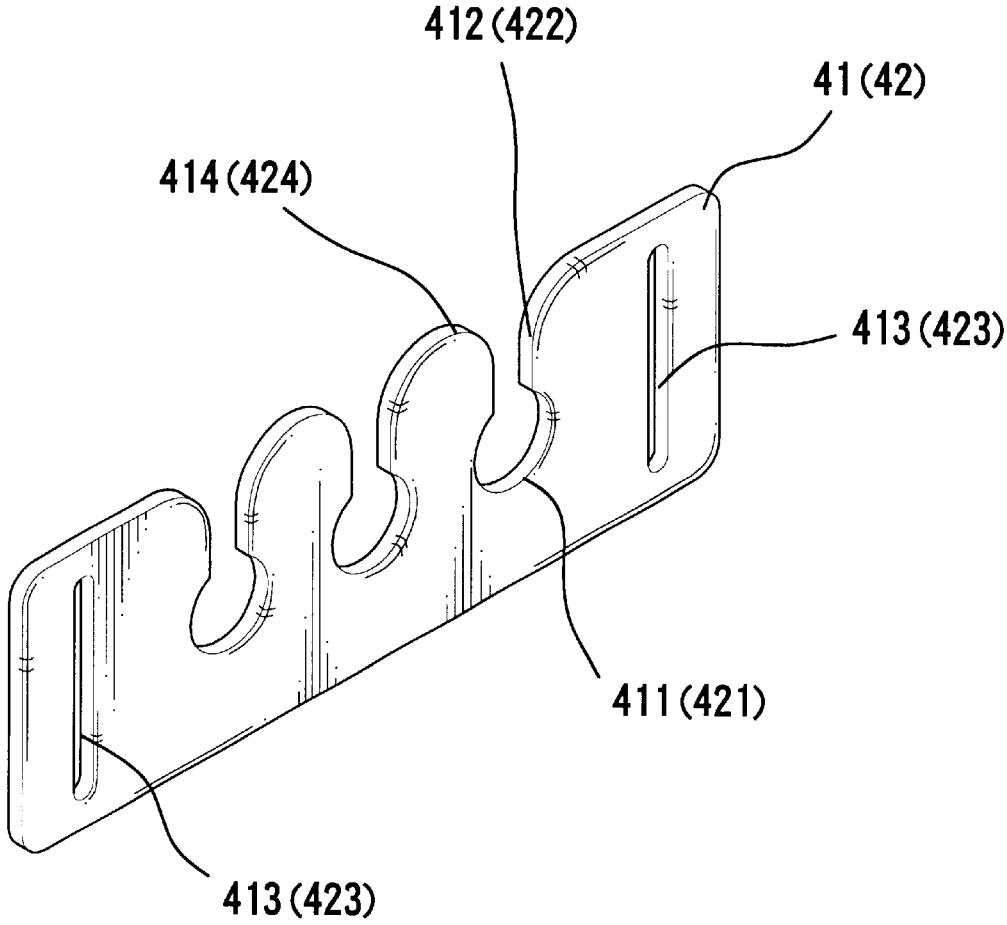
FIG. 3 is a perspective view of a positioning plate of the adjustable pull exerciser in accordance with the present invention.
Figure 4:
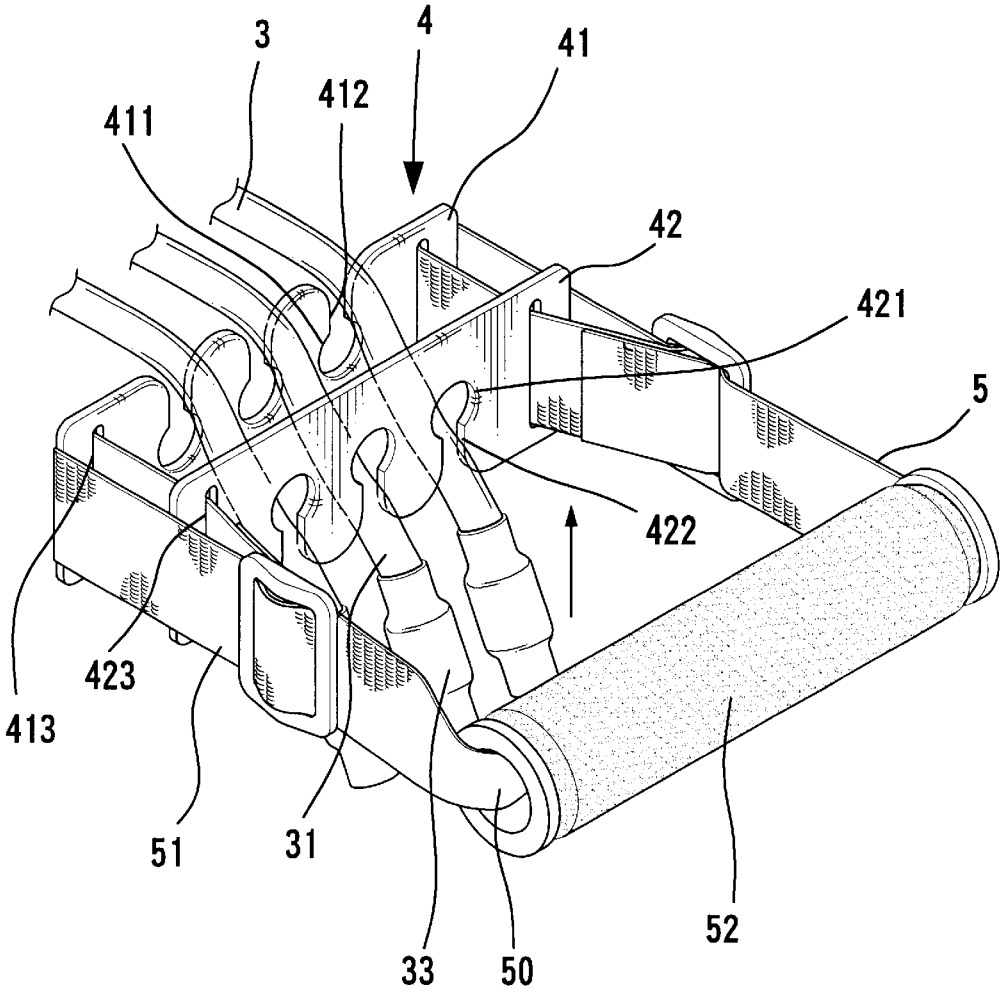
FIG. 4 is a view similar to FIG. 2, illustrating adjustment of the adjustable pull exerciser in accordance with the present invention.
Figure 5:
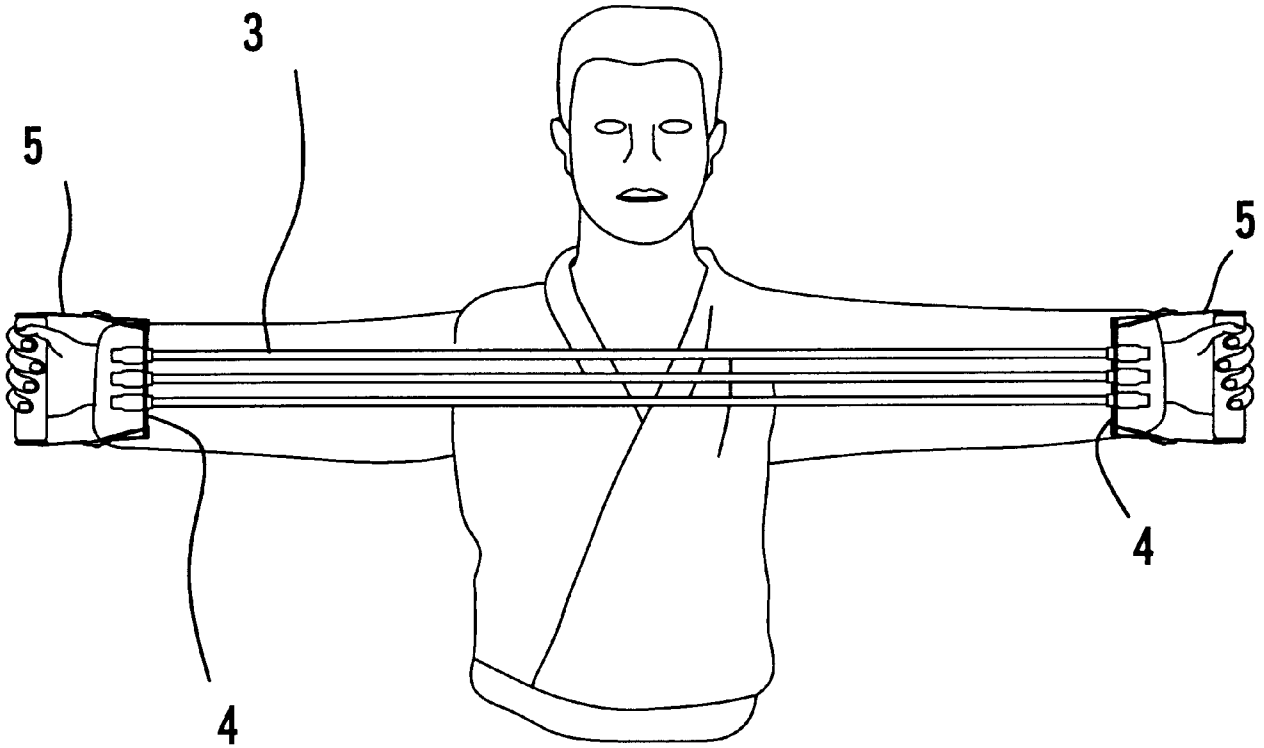
FIG. 5 is a schematic view illustrating use of the adjustable pull exerciser in accordance with the present invention.
Figure 6:
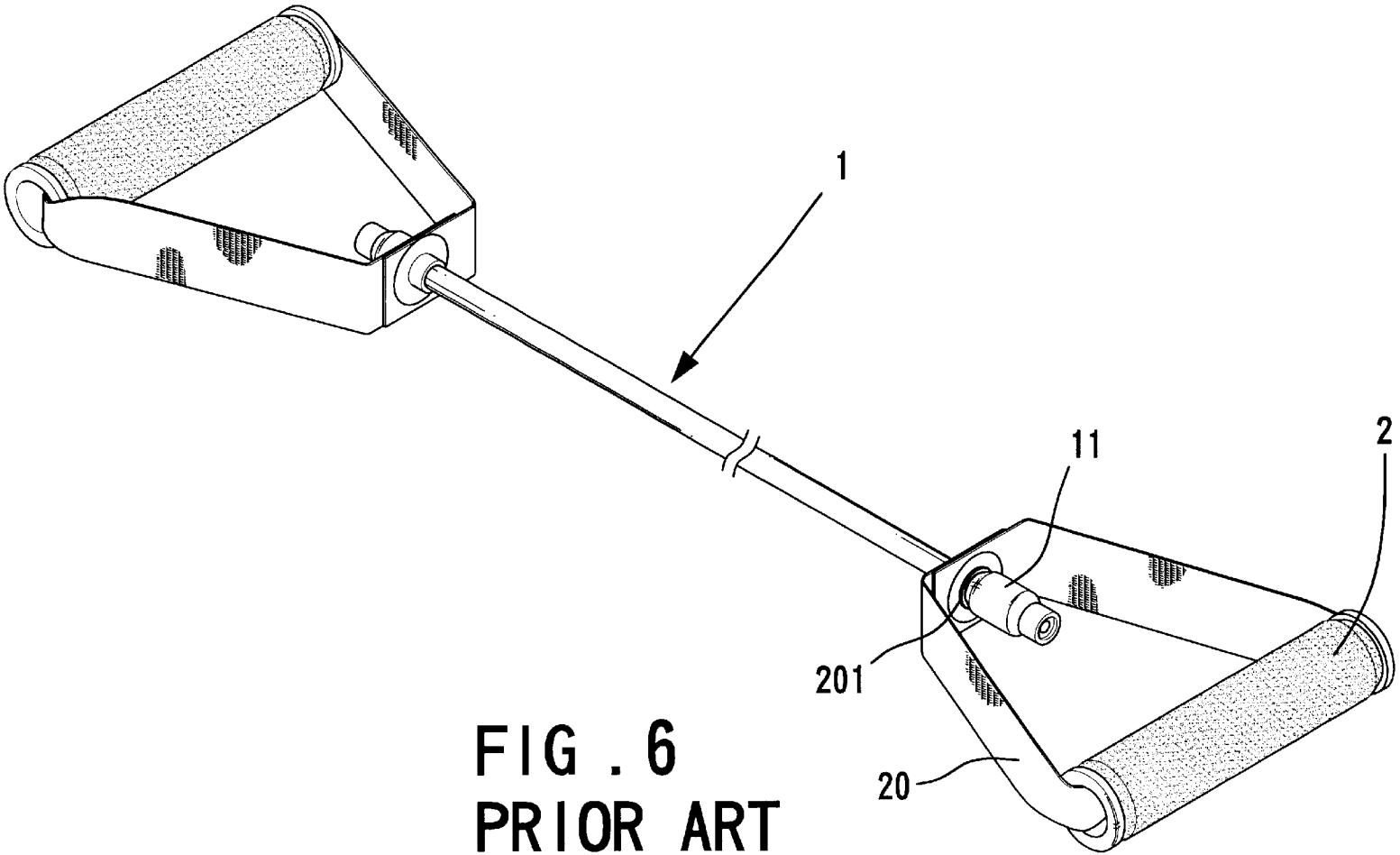
FIG. 6 PRIOR ART
FIG. 6 is a perspective view of a conventional pull exerciser.

Referring to FIGS. 2 through 4, each positioning device 4 includes two positioning plates 41 and 42 each having a slot 413, 423 in each of two ends thereof. The respective belt 51 is extended through the respective handle 52 and the slots 413 and 423 of the positioning plates 41 and 42. Since the length of the belt 51 is adjustable, the belt 51 can be adjusted to a state shown in FIG. 4 in which the positioning plates 41 and 42 are spaced apart from each other for adjustment. After adjustment, the belt 51 is adjusted to a position shown in FIG. 2, in which the positioning plates 41 and 42 are in contact with each other.

Still referring to FIGS. 2 and 3, each positioning plate 41, 42 includes at least one positioning hole 411, 421 (three in this embodiment) that is communicated with the outside via a reduced opening 412, 422 having a width smaller than a diameter of the respective positioning hole 411, 421. As illustrated in FIG. 4, the positioning plates 41 and 42 are so positioned that the reduced openings 412 of the positioning plate 41 face upward and that the reduced openings 422 of the positioning plate 42 face downward. Thus, each resilient cord 3 can be inserted into an associated positioning hole 411 of the positioning plate 41 from top and then into an associated positioning hole 421 of the positioning plate 42 from bottom, best shown in FIG. 4. Next, the length of the belt is adjusted to make the positioning plate 41 contact the positioning plate 42, best shown in FIG. 2. Each resilient cord 3 is reliably positioned. The end piece 33 on each end 31, 32 of each resilient cord 3 has a diameter greater than that of the respective positioning hole 411, 421, thereby preventing the resilient cord 3 from disengaging from the respective positioning hole 411, 421. Preferably, each positioning plate 41, 42 includes an arc-shaped guide portion 414, 424 adjacent to each reduced opening 412, 422 to allow smooth insertion of the respective resilient cord 3 into the respective positioning hole 411, 421. The respective resilient cord 3 is so sized to be extendible through the respective positioning hole 411, 421. Further, each positioning hole 411 of the positioning plate 41 is aligned with an associated positioning hole 421 of an associated positioning plate 42.

The user may grip the handles 52 and pull the resilient cords 3 to achieve the exercising function. If adjustment is required, the user may adjust the length of the belt until the positioning plates 41 and 42 are spaced apart (see FIG. 4). Then, the user may replace at least one of the resilient cords 3 with other resilient cord having a different elastic coefficient. Further, the user may remove one or two of the resilient cords 3 from the pull exerciser. The pull resistance of the pull exerciser is accordingly altered.

Although the invention has been explained in relation to its preferred embodiment, it is to be understood that many other possible modifications and variations can be made without departing from the scope of the invention as hereinafter claimed.

What is claimed is:

1. A pull exerciser comprising:

two attachment members each having a grip portion;

two positioning devices respectively attached to the attachment members at a location opposite to the grip portion of an associated one of the attachment members, each said positioning device including a first positioning plate and a second positioning plate, the first positioning plate including at least one first positioning hole that is communicated with outside via a first reduced opening having a width smaller than a diameter of said at least one first positioning hole, the second positioning plate including at least one second positioning hole that is communicated with outside via a second reduced opening having a width smaller than a diameter of said at least one second positioning hole; and at least one resilient cord having two ends each of which is insertable into said at least one first positioning hole of the first positioning plate through the first reduced opening of the first positioning plate of an associated one of the positioning devices and into said at least one second positioning hole of the second positioning plate through the second reduced opening of the second positioning plate of an associated one of the positioning devices, said at least one resilient cord being so sized to be extendible through said at least one positioning hole of the first positioning plate and said at least one positioning hole of the second positioning plate, an end piece being fixed to each of the ends of said at least one resilient cord and having a diameter greater than the diameter of said at least one first positioning hole of the first positioning plate and said at least one second positioning hole of the second positioning plate.

2. The pull exerciser as claimed in claim 1, with a tubular handle being mounted to the grip portion of each said attachment member.

3. The pull exerciser as claimed in claim 1, wherein each said attachment member is a belt.

4. The pull exerciser as claimed in claim 1, wherein each said attachment member is adjustable in length.

5. A pull exerciser comprising:

two tubular handles;

two belts that are adjustable in length, each said belt extending through an associated one of the tubular handles;

two positioning devices respectively attached to the belts at a location opposite to an associated one of the tubular handles, each said positioning device including a first positioning plate and a second positioning plate, each of the first positioning plate and the second positioning plate having two slots defined in two ends thereof through which an associated one of the belts extends, each of the first positioning plate and the second positioning plate having a plurality of positioning holes, each said positioning hole being communicated with outside via a reduced opening having a width smaller than a diameter of a respective positioning hole; and a plurality of resilient cords each having two ends respectively insertable into an associated one of the positioning holes of the first positioning plate through a respective reduced opening of the first positioning plate and into an associated one of the positioning holes of the second positioning plate through a respective reduced opening of the second positioning plate, each said resilient cord being so sized to be extendible through the positioning holes of the first positioning plate and the second positioning plate, an end piece being fixed to each of the ends of each said resilient cord and having a diameter greater than the diameter of each said positioning hole of the first positioning plate and the second positioning plate, at least one of said resilient cords being selectively attached to the positioning devices.

6. The pull exerciser as claimed in claim 5, wherein the resilient cords have different elastic coefficients.

7. The pull exerciser as claimed in claim 5, wherein for each said positioning device, each of the reduced openings of the first positioning plate faces in a first direction, and wherein each of the reduced openings of the second positioning plate daces in a direction opposite to the first direction.

8. The pull exerciser as claimed in claim 5, wherein each said belt is adjustable to allow the first positioning plate and the second positioning plate of an associated one of the positioning devices to be spaced apart to allow removal/mounting of at least one of the plurality of resilient cords and to allow the first positioning plate to be in contact with the second positioning plate of an associated one of the positioning devices after the removal/mounting of at least one of the plurality of resilient cords.

9. The pull exerciser as claimed in claim 5, wherein each said positioning hole of the first positioning plate is aligned with an associated one of the positioning holes of an associated one of the second positioning plate.

* * * * *